United States Patent [19]

Lichtman et al.

[11] 4,068,848

[45] Jan. 17, 1978

[54] PROFESSIONAL MALPRACTICE BOARD GAME APPARATUS

[76] Inventors: Allan S. Lichtman, 18370 Burbank Blvd., Tarzana, Calif. 91358; Rosemary R. Lichtman, 22448 Calipatria Drive, Woodland Hills, Calif. 91364

[21] Appl. No.: 652,555

[22] Filed: Jan. 26, 1976

[51] Int. Cl.[2] ..... A63F 3/00

[52] U.S. Cl. ..... 273/257

[58] Field of Search ..... 273/134

[56] References Cited

U.S. PATENT DOCUMENTS

| | | | |
|---|---|---|---|
| 1,674,866 | 6/1928 | Klein | 273/134 AD |
| 3,656,751 | 4/1972 | Glass et al. | 273/134 B |
| 3,740,038 | 6/1973 | Feulner | 273/134 AD |
| 3,951,411 | 4/1976 | Hill et al. | 273/134 AD |

FOREIGN PATENT DOCUMENTS

| | | | |
|---|---|---|---|
| 915,550 | 1/1963 | United Kingdom | 273/134 AT |

*Primary Examiner*—Delbert B. Lowe
*Attorney, Agent, or Firm*—William H. Pavitt, Jr.

[57] ABSTRACT

Apparatus for playing an adult game based upon possible legal and business activities and possible experiences of selected professional type persons. Spaces are provided on a board for the movement of symbolic elements representing each professional person with the number of spaces moved determined by chance, subject, however, to specific instructions affecting the movement of the symbolic elements as determined by instructions on the spaces on the board. A stack of cards is provided for each professional space on the second board, with each card providing either good or bad information concerning a client's relationship with the person of that profession and on the basis thereof, if the card information is good, indicating the amount of money to be paid by the client to the professional person; or, if bad, a basis for a malpractice suit and the formula for a possible monetary recovery against the professional person through suit or arbitration of the matter. Additionally, a plurality of verdict cards are provided to be drawn by the players in accordance with instructions set forth in the spaces representing the litigation steps, some of the verdict cards representing positive votes for recovery against the defendant; and others, negative votes denying recovery.

8 Claims, 1 Drawing Figure

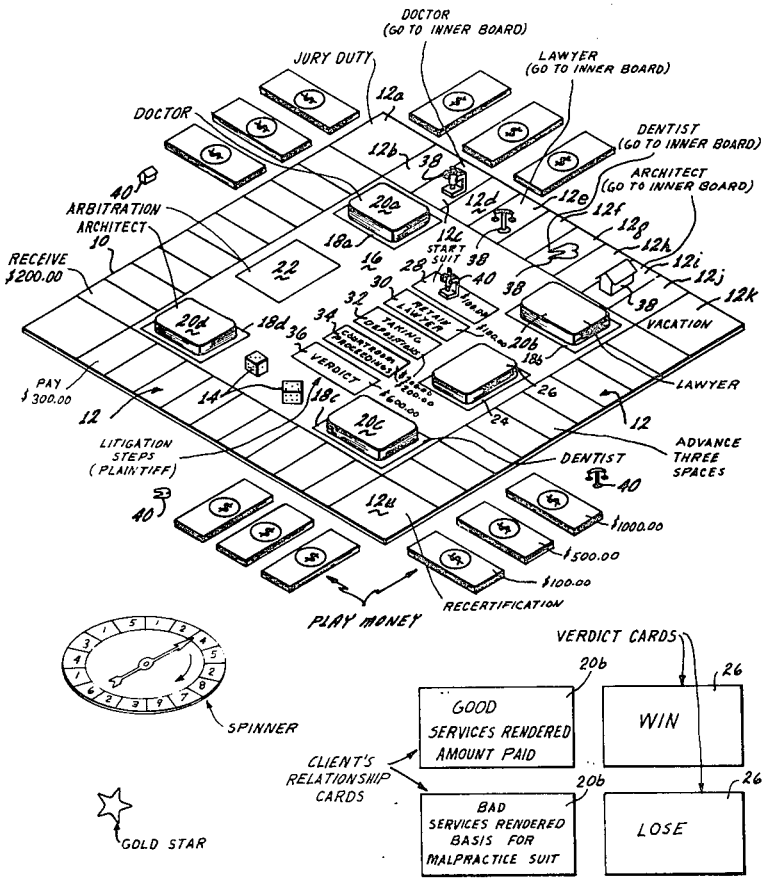

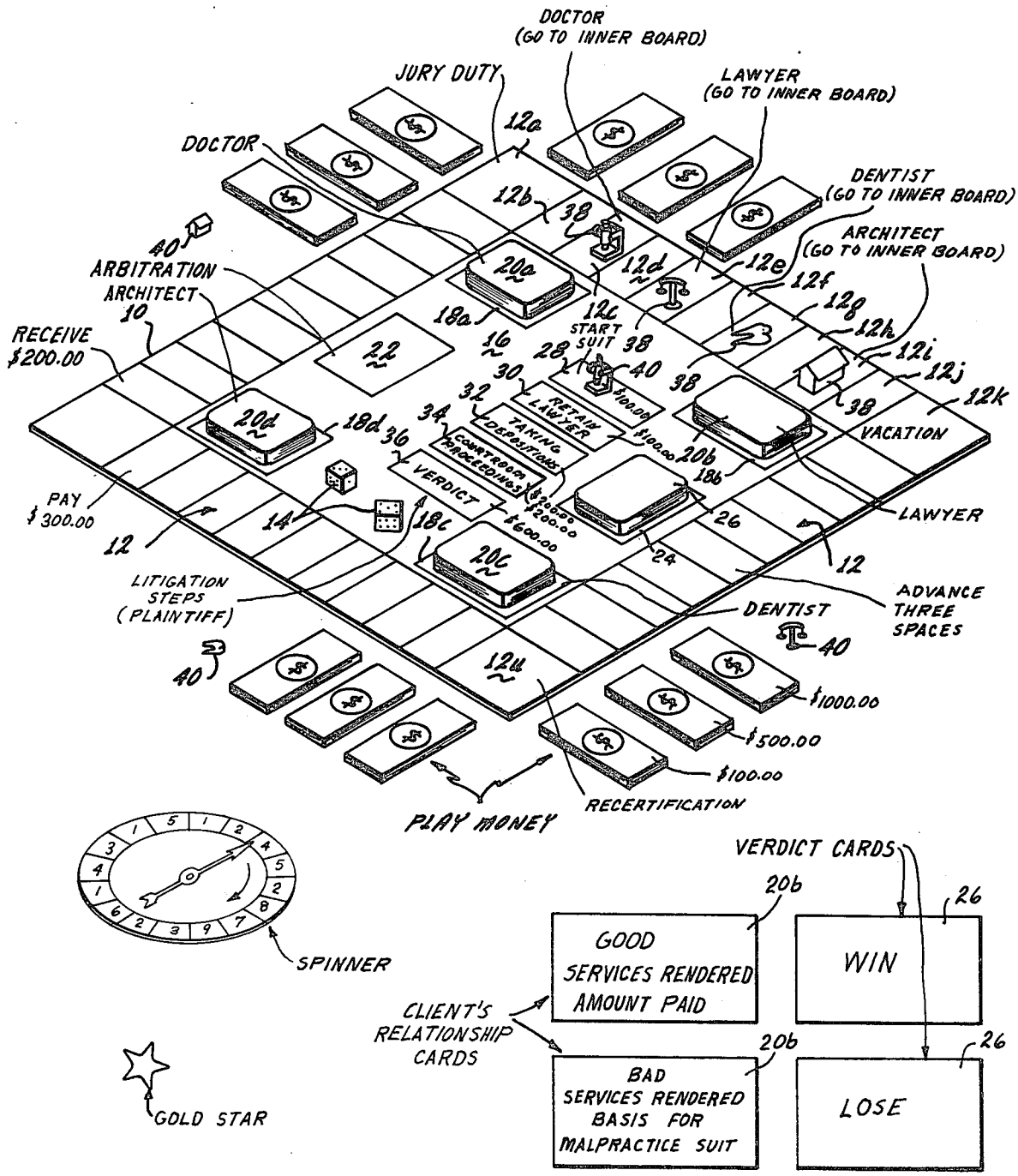
DOCTOR
(GO TO INNER BOARD)
JURY DUTY
LAWYER
(GO TO INNER BOARD)
DOCTOR
DENTIST
(GO TO INNER BOARD)
ARCHITECT
(GO TO INNER BOARD)
ARBITRATION
ARCHITECT
RECEIVE
$200.00
START
SUIT
RETAIN
LAWYER
TAKING
DEPOSITIONS
COURTROOM
PROCEEDINGS
VERDICT
VACATION
LAWYER
PAY
$300.00
LITIGATION
STEPS
(PLAINTIFF)
ADVANCE
THREE
SPACES
DENTIST
$1000.00
$500.00
$100.00
RECERTIFICATION
PLAY MONEY
SPINNER
GOLD STAR
VERDICT CARDS
CLIENT'S
RELATIONSHIP
CARDS
GOOD
SERVICES RENDERED
AMOUNT PAID
WIN
BAD
SERVICES RENDERED
BASIS FOR
MALPRACTICE SUIT
LOSE

PROFESSIONAL MALPRACTICE BOARD GAME APPARATUS

BACKGROUND OF THE INVENTION

1. Field Of The Invention

This invention relates to the field of adult games of the type which are intended to be played by a plurality of players with the winner determined by the player who has accumulated the greatest amount in value of play money.

2. Description Of The Prior Art

For a number of decades, a game called "MONOPOLY" has been popularized, this game being based upon the concept of the players accumulating, by movements determined by chance of pieces on a board, evidence of various fictitious real estate, commercial and industrial possessions and amounts of play money in reference thereto. This game of MONOPOLY appears to have maintained its popularity among American families for at least three or four decades. The game has a certain educational value for school age children in that they are introduced to certain institutions, business practices and terminology in reference thereto. The game may be enjoyed by adults, particularly when it is played by them with younger members of their families. It is not, however, always the type of game which might be played and enjoyed only by adults and is of limited value in educating adults, with reference to institutions and business practices, in that it does not call for much in the way of the exercise of judgments except from a monetary gambling standpoint.

Since the first introduction of the game of MONOPOLY, other games, from time to time, have been developed employing some procedures similar to those of the game of MONOPOLY and having somewhat similar objectives. However, neither the game of MONOPOLY nor those games subsequently developed appear to provide any type of serious education concerning the legal and business activities and problems and possible experiences of persons engaged in certain of the more prominent professions, such as law, accounting, medicine, dentistry, architecture, etc., nor have any of such games attempted to deal particularly with the progress of litigations involving any of such professional persons or to require the exercise of mature adult judgments in dealing with such litigations as, for example, whether to proceed with the litigation, to settle the same or to arbitrate the same.

There has thus existed prior to the present invention a need for an adult game whereby people may be educated concerning the nature of the business and involvements of professional persons, including their experiences with the Anglo-American Judicial system.

SUMMARY OF THE PRESENT INVENTION

The present invention provides means for the playing of a game whereby the participants not only may become educated concerning the legal and business activities and problems and possible experiences of people engaged in certain professions and concerning their possible involvements in litigation matters, but it also enables the participants to attempt to exercise mature judgments in determining the courses of the litigation in which they may become involved, including the arbitration and settlement of malpractice cases, or following them through to trial. In effect, two separate game progress boards are provided, the first game board having defined thereon a plurality of consecutive spaces constituting a path of travel for each player's movable element which is used on that board. The number of spaces traveled is determined by a chance element which may be either in the form of dice or a spinning wheel with numbers indicated thereon. Instructions on the spaces, however, may also affect the progress of the player's movable element, including periods of stagnation, such as jury duty, vacation and recertification. The instructions also specify in most spaces the payment to or by the player, whose element lands on such space, of money in an amount indicated on such space. Such amounts would further be affected by the professional's recertification. Some of the spaces, however, indicate the development of a relationship between the player and one of the several persons in the other selected professions. When a player's element lands on any of the latter type spaces, the player then proceeds to a second board. The second board has a first group of spaces, one for each of the several professions selected for the game, and a second group of spaces, each of which constitutes a step in a litigation with an alternative space for arbitration. Instructions are provided on each of the litigation steps for the payment by the plaintiff-player of various types of litigation costs. Two different groups of cards are employed with this second board. The first group of cards comprises a pack for each of the several involved professions. Some of these cards describe a professional activity successfully conducted, and call for the payment of money by the player-client who draws the card to the player who represents that profession. Others of the cards, however, describe some type of possible malpractice on the part of the member of the profession, thereby providing the player whose element has landed on that profession's space on the first board with a basis for proceeding to arbitrate damages or to proceed with a litigation against such member of the profession. In the second group of cards, one or more of which are to be drawn as each step of the litigation progresses, are cards which either represent a favorable or unfavorable verdict in that litigation. So long as the plaintiff-player is involved in the litigation on the second board, his movable element on the first board remains in the professional space in which it landed and thereby requires the player to utilize further turns in concluding his activities on the second board. As a player proceeds with the litigation, the parties may agree to settle the same at any time. After the litigation is concluded, either by arbitration, trial to final verdict, or settlement, the plaintiff-player is then entitled to proceed again to use his turns in moving his element on the first board.

By providing in the spaces on the first board and in the stacks of professional cards, explanations of many different types of experiences, professional activities, and breaches of professional duties, persons playing the game may be better educated in these areas. In addition, taking a player through various steps of the litigation will educate him in the Anglo-American Judicial system and may demonstrate to the players the desirability of settling such litigations.

BRIEF DESCRIPTION OF THE DRAWING

The accompanying drawing is a perspective view of the means of the present invention which may be employed to play the game, including the boards, movable elements and groups of cards.

DESCRIPTION OF THE PREFERRED EMBODIMENT

Referring to the drawing, it may be seen that there is provided an outer perimeter 10 comprising a series of rectangular spaces denoted generally as 12, and specifically as 12*a*, 12*b*, 12*c*, 12*d*, etc. In the particular embodiment of the present invention which is illustrated in the drawing, it is contemplated that four different professionals will be involved. One space 12*c*, 12*e*, 12*g* and 12*i*, for example, is provided for each of said four professions, respectively, on the top side of the perimeter 10, and similarly, in correspondingly located spaces on each of the other three sides of the rectangular perimeter 10. The corner spaces (for example, 12*a* and 12*k*) represent periods of stagnation as, for example, jury duty and vacation, and the other spaces (12*b*, 12*d*, 12*f*, 12*h*, 12*j*) indicate a winning or losing of money in an amount equal to some multiple of the roll of the dice 14 — in some instances, depending upon whether the roll of the dice may be odd or even. One of the spaces (e.g., 12*u*) representing the periods of stagnation may be denominated "recertification", indicating that the player loses one turn, but acquires a gold star. This entitles the player to receive doubled professional fees whenever he is to be paid such a fee for services rendered. Recertification may, however, occur only once. Within the perimeter 10 of spaces 12 may be provided a second board 16, having four corner spaces 18*a*, 18*b*, 18*c* and 18*d*, each representing a repository for a stack of cards applicable to the relationship between a client and a member of one of the four professions. Thus, the doctor space is 18*a*, the lawyer space is 18*b*, the dentist space is 18*c*, and 18*d* is for the architect. Each stack of cards 20*a*, 20*b*, 20*c*, 20*d*, again representing one of the four professions in the same order, will be deposited on the four professional spaces, 18*a*, 18*b*, 18*c* and 18*d*, respectively. Space 22 is labeled "Arbitration", and the space 24 is a repository for the verdict cards 26. Half of the verdict cards 26 are marked "Win" on one side and are left blank on the other. A centrally disposed group of spaces 28, 30, 32, 34 and 36 represent successive litigation steps with the player (known as the plaintiff) starting the suit and continuing it, being required to pay money in accordance with instructions set forth in the spaces 28, 30, 32, 34 and 36.

Each player is provided with two movable elements 38 and 40, both of which are configured desirably in some symbol of the particular profession selected by the player (for example, a microscope for a doctor, scales for a lawyers, a tooth for a dentist, and a building for an architect). The element 38 is intended to be used by the player in moving about the spaces 12 constituting the perimeter 10, while the element 40 is for use by the player in his movements on the inner board 16.

In playing the game, each player selects a pair of elements or pieces 38,40 representing the profession of his choice. In the event that two or more players desire the same profession's pieces, the players may decide who has the choice by throwing the dice. After a player has selected the pieces 38,40 of his chosen profession, he places his piece 38 on any of the four spaces in the perimeter 10 in which such chosen profession is designated. For example, if a player has selected the microscope configured element 38, he may place his element 38 on the space 12*c*, labeled "Doctor". He also shuffles the cards 20*a* which indicate the outcome of the professional services rendered by him and places them face down on the space 18*a* in the inner board. In addition, the verdict cards 26 are shuffled and placed face down on the space 24. Each player is entitled to receive at the outset play money in a predetermined total value, preferably in a number of different denominations. The players roll the dice to determine the order in which the players will take their turns, the player rolling the highest number starting first. Each player in turn will roll the dice and move his element 38 around the spaces 12 in the perimeter 10 corresponding to the total of the dice roll. Should a player's element or piece 38, when so moved, land in the space of a profession other than that represented by his own symbol 38, the player proceeds to draw the top card of the stack of cards for such other profession disposed on the inner board. For example, if a doctor's element 38 has landed on a lawyer's space 12*e*, the player then proceeds to draw the top card of the stack of lawyer cards 20*b*, disposed on the space 18*b* on the board 16. If the card 20*b* so drawn is one which indicates that the services rendered were beneficial to the client, the card 20*b* will indicate the fee to be paid to the player representing that particular profession. On the other hand, if the card 20*b* so drawn indicates that the services rendered constitute possible malpractice, the player drawing the card 20*b* may initiate suit and does so by taking his other element 40 and placing it on the space 28 which is marked "Start Suit". The player's element 38 at this point remains on the space (e.g., 12*e*) in the perimeter 10 through all of that player's subsequent turns until the suit matter has been adjudicated or otherwise disposed of. Once the player has placed his symbol 40 in the space 28, marked "Start Suit", that player must utilize all subsequent turns to conclude the litigation one way or another. After such conclusion, the player's element 40 is removed from the board 16 and the player then resumes progress with his element 38 over the spaces 12 of the perimeter 10. Although the plaintiff-player with the commencement of his litigation is confined to board 16 for further turns until the litigation is concluded, the professional person being sued as a defendant does not place any second element 40 on the board 16, but continues to utilize his turns in moving his own element 38 about the spaces 12 of perimeter 10.

The space 30 is marked "Retain Lawyer". On the next turn of the player (the "Plaintiff") who has started the suit, such player must decide how to proceed against the defendant. The plaintiff may choose arbitration or trial. If the plaintiff chooses arbitration, he moves his element 40 to the space 22, labeled "Arbitration", pays a filing fee of $100.00 and rolls the dice. All rolls of the dice result in the plaintiff winning arbitration, except a roll of double numbers. The total (other than that of a double) which appears on the dice is multiplied by either $100, $200 or $300, depending upon the instructions on the services rendered card. If the plaintiff holds a contingency fee card, he is not required to use it, but returns it to the bottom of the lawyer's services rendered stack without having to make any payment to the lawyer. If the plaintiff wins the arbitration, the defendant pays the award directly to the plaintiff; if the plaintiff loses the arbitration, the litigation phase of the claim is terminated, whereupon the plaintiff removes his element 40 from the board 16, and resumes moving his element 38 about the spaces 12 on the perimeter 10.

If the plaintiff does not choose arbitration, his next turn is utilized to retain a lawyer. The lawyer's fee is calculated as 100 times the roll of the dice. Once the fee is determined, the plaintiff places that amount of money in front of him and the lawyer is considered retained. If the plaintiff is in the possession of a contingency fee card, the plaintiff does not roll the dice to determine the lawyer's fee and the contingency fee card is used in lieu of a retainer. Once the lawyer is reatined, the plaintiff and defendant each pick one of the verdict cards from the stack 26, and the "retained lawyer" turn is then considered completed. Each party should keep from disclosing his verdict card content from the other party.

The plaintiff player's next turn is utilized in taking depositions. The cost of the depositions is determined by multiplying the total turned up on the dice rolled by 100. The money to be paid by the plaintiff-player is again placed in front of the latter and at this time both the plaintiff- and defendant-players each draw two more veridct cards 26, again keeping their contents secret from each other. It should be pointed out that as the plaintiff progresses from the "Start Suit" box 28 to each subsequent litigation box 30, 32, 34 and 36, he moves his element 40 accordingly.

When the plaintiff player's third turn comes up after he has started suit, the courtroom proceedings occur. Again, the cost of these proceedings may be determined in the same way as the cost of the depositions and the amount to be paid by the plaintiff-player is also placed in front of him. At this stage, both plaintiff and defendant each pick four more verdict cards 26.

The next turn moves the plaintiff's element 40 to the verdict box 36. At this stage of the litigation proceedings, the plaintiff and defendant players may attempt to settle the case based upon what they estimate their respective chances to be from the number of favorable votes they have in their respective sets of verdict cards 26 which they have drawn. If no settlement is reached by the two players, the plaintiff rolls the dice and the possible award is determined by multiplying the thousand number indicated on the original services rendered card (20*a*, 20*b*, 20*c* or 20*d*) which produced the basis for the suit times the total which appears on the roll of the dice. After the amount of possible recovery is known, as a result of this dice roll, one or both of the party players may again negotiate for a settlement of the litigation instead of proceeding to reveal the contents of their respective verdict cards 26. If no settlement is reached at this stage, the verdict cards 26 are turned over to expose their "win" or "lose" sides, one at a time. Even in the course of this verdict card revealing process, either party may still attempt to negotiate a settlement. But if no settlement should materialize, all of the verdict cards 26 are finally put down to reveal their contents and the player with the most positive ("win") verdict cards is the winner of the suit. If the plaintiff-player is the winner, the defendant pays the money award to the plaintiff; but if the plaintiff has retained a lawyer on a contingency fee card, the plaintiff must pay to his or her lawyer that percentage of the award indicated on such card. All amounts paid by plaintiff as costs of the litigation and put down in front of him as the litigation progressed goes to the bank if the plaintiff wins the case. On the other hand, if the defendant wins, all such monies are paid to the defendant as compensation for the unsustained claim made against him.

Should the suit end with both the plaintiff and the defendant having an equal number of positive verdict cards 26, the plaintiff may either (a) elect to re-try the case, in which event his element 40 is placed back on the "Start Suit" space 28 and he proceeds in the same manner he did previously; (b) make a further attempt to settle the case; (c) take the case to arbitration; or (d) drop the case altogether, in which event he removes his symbol 40 from the board and returns to the perimeter spaces and proceeds with his symbol 38.

It is contemplated that in one embodiment of the invention the spaces 12 constituting the perimeter 10 in the FIG. 1 embodiment would be on a separate board and could be laid out in any consecutive pattern and not necessarily rectangular. It would also be possible to have the game played by laying out the spaces 12 comprising the perimeter 10 in such a manner that they terminate at an ending point which, when reached by any player, could terminate the game. As contemplated in the embodiment of FIG. 1, however, the game would be played either for a predetermined period of time (e.g., one hour or two hours), or until one or more players have lost all of the play money issued to him or them.

From the consideration of the foregoing and the accompanying drawing, it will be appreciated that a game played with the means provided by the present invention, not only educates persons concerning the experiences, work problems and duties involved in each of the selected professions, but the players are given an opportunity better to understand the Anglo-American Judicial system and to attempt to exercise judgment in the proper conduct of litigation under such system.

We claim:

1. Means to play an adult game based upon possible legal and business activities and possible experiences of persons in selected professions, said means comprising:

a. a plurality of movable elements, at least one of said elements to be provided each player;

b. means for each player, when his turn comes up, to develop by chance a numerical factor;

c. a first board, said first board having defined thereon a plurality of consecutive spaces constituting a path of travel for said movable elements, the number of spaces to be traveled by each element at the turn of its player, being determined by the numerical factor developed by such player upon using said means to develop said numerical factor; each of said spaces having instructions thereon, said instructions either (i) affecting the movement of the movable element over said spaces; (ii) providing for the payment to or by the player whose elements land on such space, of money in an amount as stated on such space; or (iii) directing the player to proceed to a second board for instructions;

d. a second board, said second board having defined thereon a number of first spaces, one of each of said first spaces being provided for each of the selected professions, and a plurality of second spaces, each of said second spaces constituting a step in a legal proceeding and indicating the amount of money to be paid by the plaintiff in said proceeding with each step of the litigation;

e. a plurality of groups of first cards, each group of said first cards providing information either good or bad, concerning a client's relationship with the person of the particular one of said professions and, on the basis thereof, if good, indicating the amount of money to be paid by such client and returning the player to his position on the first board for further movement of his element on the spaces of the first board; or, if bad, providing a basis for a malpractice suit and the formula for a possible monetary recovery against the professional person if a suit should be brought against the latter, or an arbitration thereof conducted, with a successful result;

f. a plurality of second cards, said second cards being verdict cards, some of which represent positive votes for recovery against the defendant and others negatives votes denying recovery to the plaintiff; and g. play money in various denominations.

2. The means as described in claim 1 wherein the first board has its spaces laid out in an endless pattern to define an open central area and the second board is disposed within said defined area.

3. The means as described in claim 2 wherein the spaces in the first board are laid out in a rectangular pattern.

4. The means as described in claim 1 wherein the means for each player to develop by chance a numerical factor comprises at least one die.

5. The means as described in claim 1 wherein the means for each player to develop by chance a numerical factor comprises a spinning arrow with the 360° arc about the axis of which being divided into spaces labeled with different numbers.

6. The means as described in claim 1 wherein two of the movable elements are provided to each player, one for use in conjunction with the first board and the second for use in conjuction with the second board.

7. The means as described in claim 1 wherein a movable element provided to each player is configured to symbolize the particular profession selected by the player.

8. The means as described in claim 1 wherein one of the spaces on the first board is denominated "recertification".

* * * * *